US007042318B2

(12) United States Patent
Barnes et al.

(10) Patent No.: US 7,042,318 B2
(45) Date of Patent: May 9, 2006

(54) SHIELDED SURFACE-MOUNT COAXIAL EDGE LAUNCH CONNECTOR

(75) Inventors: Heidi L. Barnes, Forestville, CA (US); Marshall G. Ward, III, Santa Rosa, CA (US); Al Willits, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 47 days.

(21) Appl. No.: 10/733,982

(22) Filed: Dec. 10, 2003

(65) Prior Publication Data

US 2004/0119557 A1 Jun. 24, 2004

Related U.S. Application Data

(63) Continuation-in-part of application No. 10/269,710, filed on Oct. 10, 2002.

(51) Int. Cl.
*H01P 5/08* (2006.01)

(52) U.S. Cl. ..... 333/260; 333/33; 439/581; 439/63

(58) Field of Classification Search ..... 333/246, 333/33, 34, 260; 439/581, 63, 59
See application file for complete search history.

(56) References Cited

U.S. PATENT DOCUMENTS 5,339,187 A * 8/1994 Nelson ..... 398/91
5,532,659 A * 7/1996 Dodart ..... 333/260
5,897,384 A * 4/1999 Hosler, Sr. ..... 439/63
6,535,088 B1 * 3/2003 Sherman et al. ..... 333/238
6,661,318 B1 * 12/2003 Tamaki et al. ..... 333/260
2001/0042907 A1 * 11/2001 Tamaki et al. ..... 257/673
2003/0052755 A1 3/2003 Barnes et al. ..... 333/260

OTHER PUBLICATIONS

Neu, Designing Controlled-Impedance Vias, EDN, 67-72 (Oct. 2, 2003).

* cited by examiner

*Primary Examiner*—Stephen E. Jones

(57) ABSTRACT

A coaxial interface to a planar transmission structure of a printed circuit board ("PCB") is provided in a shielded edge launch connector. The shielded edge launch connector is suitable for use in surface mount technology ("SMT") applications. A center pin of the shielded edge launch connector is soldered to a solder pad on the PCB, which couples the center pin to a center conductor of the planar transmission structure. Shielding incorporated in the shielded edge launch connector is soldered to ground areas on a surface of PCB, electromagnetically shielding the center and providing a ground path to wrap ground current around the center pin from the surface of the PCB. Wrapping the ground current to a surface of the PCB reduces the sensitivity of the high-frequency performance of the system to PCB thickness and edge tolerances, providing improved impedance continuity.

13 Claims, 4 Drawing Sheets

SHIELDED SURFACE-MOUNT COAXIAL EDGE LAUNCH CONNECTOR

CROSS-REFERENCE TO RELATED APPLICATIONS

This application is a continuation-in-part of commonly owned U.S. patent application Ser. No. 10/269,710 entitled SHIELDED SURFACE MOUNT COAXIAL CONNECTOR, filed Oct. 10, 2002 by Heidi L. Barnes, Andrew N. Smith, and Floyd A. Bishop and published Mar. 20, 2003 under Pub. No. US 20030052755, the disclosure of which is hereby incorporated in its entirety for all purposes.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates generally to high-frequency circuits and systems, and more particularly to a coaxial connector configured to be mounted on an edge of a planar circuit operating at radio frequencies and above.

BACKGROUND OF THE INVENTION

High-frequency circuits are often manufactured on printed circuit assemblies ("PCAs"). High-frequency launch connectors are used to bring high frequency signals, such as radio frequency ("RF") signals and microwave signals, on and off the PCA. High-frequency launch connectors have a coaxial connector interface on one end, and connect to the PCA on the other end. A variety of types of coaxial connector standards are known and in widespread use, such as SMA, SMB, SMC, SSMA, 3.5-mm, 2.4-mm, and 1.85-mm standards. Coaxial cables with a mating coaxial interface are connected to the coaxial connector interface of the high-frequency launch connector on the PCA. Generally, each of the various coaxial connector types is available in a variety of styles that are adapted for various applications.

Some high-frequency launch connectors are designed to be assembled onto a PCA using surface mount technology ("SMT"). One SMT edge launch connector has a female-type SMA coaxial connector interface on one end and a center pin extending from the other end. The center pin is typically captivated in a dielectric material, such as TEFLON™, and forms a coaxial transmission structure having a characteristic impedance with the metal body of the SMT edge launch connector. Ledges extend away from the metal body to support the SMT edge launch connector in a cutout in a printed circuit board ("PCB") during assembly (soldering).

The center pin of the SMT edge launch connector is soldered to the center conductor of an impedance-controlled structure on the PCA. The impedance-controlled structure is typically designed to have the same characteristic impedance as the coaxial transmission structure of the SMT edge launch connector. However, a small gap often exists between the end of the center conductor on the PCB and the end of the metal body of the SMT edge launch connector. This gap forms an impedance discontinuity between the coaxial transmission structure and the impedance-controlled structure on the PCB, which degrades high-frequency performance. Similarly, the center pin can radiate and/or receive unwanted high-frequency signals. Adding shielding structures and/or tuning structures to the PCA after soldering the SMT edge launch connector adds additional cost and manufacturing time.

Also, the dielectric material in the coaxial transmission structure in the SMT edge launch connector often expands when the SMT edge launch connector is soldered to the PCB and pushes the edge launch connector away from the edge of the PCB. This creates a gap between the body of the edge launch connector and the edge of the PCA, which can further degrade high-frequency performance.

Therefore, it is desirable to provide an edge launch connector with improved impedance continuity and less susceptibility to radiating and/or receiving unwanted high-frequency signals.

BRIEF SUMMARY OF THE INVENTION

A connector includes a coaxial interface, a shielded transition block, a pin support, and a center pin. The coaxial interface can be integrated with the shielded transition block or screwed or otherwise coupled to the shielded transition block. A connector according to one embodiment has shielding configured to be soldered to a shielding solder area on a side of a printed circuit and a center pin configured to be soldered to a center pin solder pad on the side of the printed circuit board surrounded by the shielding. In a further embodiment, a view port is provided in the shielded transition block to provide a view of the center pin after it is soldered to the center pin solder pad. A lid is press-fit or soldered into the view port after the center pin solder joint is inspected. Alternatively, x-ray or other techniques are used to inspect the center pin solder joint.

In a further embodiment, a connector includes a shielded transition block that forms a controlled impedance structure with the center pin to improve impedance matching to a PCB. Embodiments include air-line controlled impedance structures between the coaxial interface and the PCB.

In another embodiment, a connector with a shielded transition block is soldered to an edge of a multi-layer printed circuit board to form a system. The system has a planar transmission structure, such as a coplanar transmission line or a microstrip transmission line, that is formed in a layer or layers of the multi-layer printed circuit board. The shielded transition block is soldered to a shielding solder area and the center pin is soldered to a center pin solder pad. A center conductor via electrically couples the center pin solder pad to a center conductor of a planar transmission structure of the printed circuit board. In a further embodiment, ground vias disposed around the center pin via are used to improve the impedance match between the coaxial interface and the planar transmission structure. In another embodiment, mechanical vias are provided in the shielding solder area.

DETAILED DESCRIPTION OF THE EMBODIMENTS

I. Exemplary Shielded Edge Launch Connectors and Assemblies

Figure 1A:
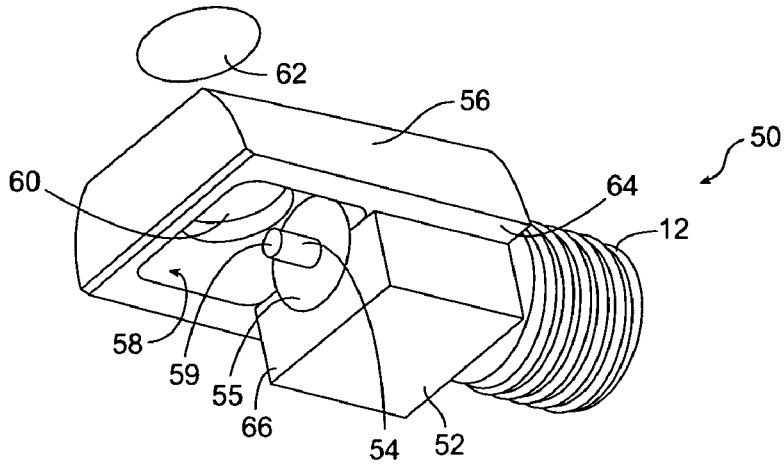
FIG. 1A shows an isometric view of a shielded edge launch connector according to an embodiment.

FIG. 1A shows an isometric view of a shielded edge launch connector 50 according to an embodiment of the present invention. The shielded edge launch connector 50 includes a coaxial connector interface 12, a shielded transition block 52, a pin support 55, and a center pin 54. The portion of the center pin that extends from the pin support 55 into the shielding cavity 58 will be referred to as "the center pin 54" for purposes of discussion, even though the center pin also extends into the pin support 55. The pin support 55 is a solid dielectric material, such as TEFLON™ or glass. The shielded transition block 52 includes shielding 56 that forms a shielding cavity 58 extending beyond the tip 59 of the center pin and covers the center pin 54 when the shielded edge launch connector 50 is soldered to a surface (e.g. top or bottom side) of a PCB (see FIG. 1B).

The shielded edge launch connector 50 provides a transition from the coaxial connector interface 12 to a controlled impedance transmission structure of a PCB or other circuit for communicating high-frequency signals to and from the PCA. The controlled impedance structure of the PCB is often a planer transmission line, for example. The shielding 56 electromagnetically shields the transition from the coaxial transmission structure of the shielded edge launch connector to the controlled impedance transmission structure of the PCB.

Furthermore, the shielding cavity 58 can be shaped to operate in cooperation with the center pin 54 to provide a controlled impedance transmission structure in the shielded edge launch connector 50. The shielding 56 wraps the ground structure of the coaxial connector interface 12 to the surface (e.g. top side) of the PCB to improve the impedance match of the center pin 54 after it leaves the pin support 55 to the impedance of the coaxial connector interface 12. Providing a shielding cavity with controlled impedance reduces the impedance discontinuity between the coaxial and planar transmission structure. Similarly, providing a shielding cavity with controlled impedance reduces the sensitivity of the PCA to PCB thickness and edge tolerances. As used herein, the term "ground" refers to the potential of the outer conductor of the coaxial connector interface 12.

The shielded transition block 52 is electrically conductive, and is typically made of metal. In some embodiments, the coaxial connector interface 12 is integrated with the shielded transition block 52, and in other embodiments the shielded transition block is configured to accept a coaxial connector interface, such as an SMA barrel, that is screwed or otherwise coupled to the shielded transition block (see FIGS. 2A and 2B).

An optional view port 60 is provided to inspect the solder joint between the center pin 54 and the PCB. In one embodiment, an automated solder paste deposit and oven reflow technique is used to solder the shielded edge launch connector to the top surface of a PCB. It is believed that the automated solder paste deposit and reflow process provides superior RF performance compared to hand-soldering techniques because the amount and placement of the solder paste is more controllable, particularly with machine-vision solder paste inspection. After solder reflow and inspection of the center pin solder joint, a metal lid 62 is press fit, and optionally soldered, into the view port 60, electrically sealing the shielding transition block 52.

The shielded transition block 52 has sidewalls 64 that engage a cutout in the PCB. In other words, the sidewalls 64 overhang the sides of the cutout and support the shielded edge connector during PCA fabrication. The sidewalls also provide soldering surface area for a strong mechanical interface between the shielded edge launch connector and the PCB. Automated SMT pick-and-place equipment provides accurate placement of the shielded edge launch connector on the PCB. The shielded edge launch connector 50 is typically pressed against the side of the PCB during solder reflow to keep an end wall 66 in contact with the edge of the PCB, and thus reduce the impedance discontinuity at the board edge. The end wall 66 is typically soldered to the bottom edge of the PCB for improved electromagnetic shielding and strength.

Figure 1B:
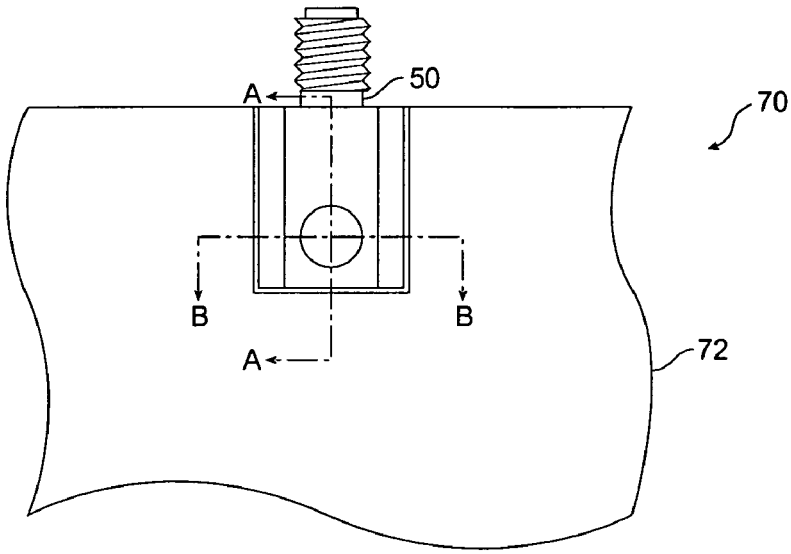
FIG. 1B shows a plan view of a printed circuit assembly with the shielded edge launch connector of FIG. 1A mounted on a PCB.

FIG. 1B shows a plan view of a PCA ("system") 70 with the shielded edge launch connector 50 of FIG. 1A mounted on a PCB 72. The shielded edge launch connector 50 is connected to a controlled impedance transmission line (not shown) formed in the PCB 72. The shielded edge launch connector 50 is used with a variety of PCBs, including PCBs having different thicknesses.

Figure 1C:
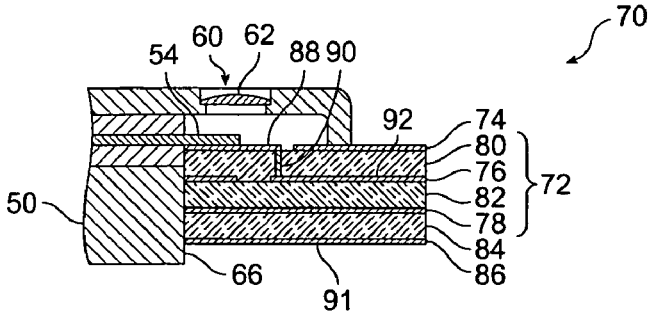
FIGS. 1C and 1D show cross sections of the printed circuit assembly shown in FIG. 1B.

FIG. 1C shows a cross section of the system 70 of FIG. 1B taken along section line A—A. The PCB 72 has metal layers 74, 76; 78, 86 separated by dielectric layers 80, 82, 84. Other PCBs have more or fewer layers. Metal layers are typically patterned to define electric circuits. A variety of dielectric materials, such as GETEC™ available from COOKSON ELECTRONICS PWB MATERIALS AND CHEMISTRY of Londonderry, N.H., or RO4350™, available from ROGERS CORP. of Chandler, Ariz., are suitable for use in a PWB having controlled impedance transmission structures.

The center pin 54 and shielding 56 are reflow soldered to exposed portions of a first patterned metal layer 74. The view port 60 allows visual inspection of the solder joint of the center pin 54 to a center pin solder pad 88. The center pin solder pad 88 couples the electronic signal from the center pin 54 to a center conductor via 90, which couples the electronic signal to a center conductor 92 formed in patterned metal layer 76. The center conductor via 90 is generally a plated hole that is optionally filled with solder. Vias are used to make electrical connections between layers of metal in PCBs. Metal layers 74, 78 form ground planes that work in cooperation with the center conductor 92 to form a planar controlled impedance transmission structure in the PCB 72.

Vias that do not extend through all layers of the PCB 72 are referred to as "blind" vias. Alternatively, a center conductor via extends all the way through the PCB to couple the electric signal from the center pin 54 to a controlled impedance transmission structure on the opposite side 91 ("bottom") of the PCB. A via extending through the PCB is also known as a through via. The back wall 66 of the shielded edge launch connector 50 is soldered to the metal layer 86, as are the sides of the shielded transition block 52 (not shown) to form a contiguous perimeter of solder between the PCB 72 and the shielded edge launch connector 50, providing complete electromagnetic shielding.

Figure 1D:
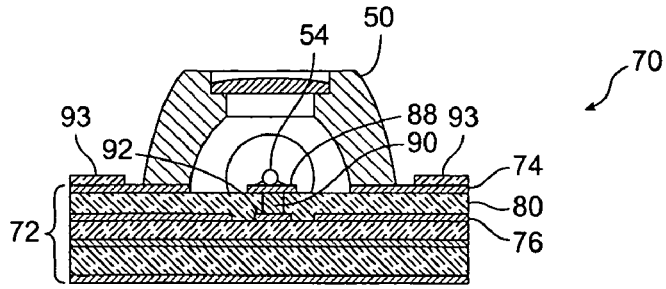

FIG. 1D shows a cross section of the system (PCA) 70 of FIG. 1B taken along section line B—B. The center pin 54 of the shielded edge launch connector 50 is soldered to the center pin solder pad 88. The center conductor via 90 is a blind via extending through the dielectric layer 80 from the center pin solder pad 88 formed in the first metal layer 74 of the PCB 72 to the center conductor 92 formed in the second metal layer 76 of the PCB 72. Solder resist 93 optionally covers portions of the metal layer 74 where solder connections will not be made.

Figure 1E:
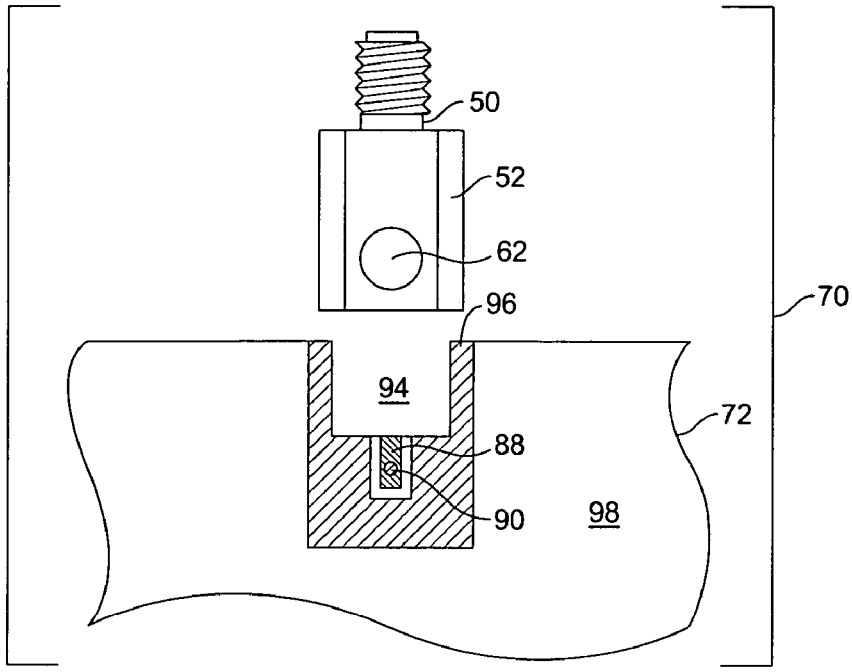
FIG. 1E shows an exploded plan view of the printed circuit assembly shown in FIG. 1B.

FIG. 1E is an exploded plan view of the system (PCA) 70 shown in FIG. 1B. The shielded edge launch connector 50 is placed in a cutout 94 in the PCB 72. The cutout 94 provides clearance for the coaxial section of the shielded edge launch connector 50 and uses overhanging sidewalls (ref FIG. 1A) to balance the shielded edge launch connector 50 in the cutout 94 during solder reflow.

The shielded transition block 52 is soldered to the PCB at an exposed metal area ("shielding solder area" represented by cross hatching) 96 of the first metal layer (see FIGS. 1C, 1D, ref. num. 74). Another portion 98 of the first metal layer is optionally covered with solder resist or other coating material. Soldering the shielded transition block 52 to the shielding solder area 96 mechanically secures the shielded end launch connector 50 to the PCB 72 and provides a continuous ground current path (i.e. "wraps" the ground current) around the center pin (see FIG. 1D, ref. num. 54) and center pin solder pad 88 on the top side of the PCB 72. Wrapping the ground current to the topside of the PCB reduces the sensitivity of the high-frequency performance of the system to PCB thickness and edge tolerances, providing improved impedance continuity.

Adequate control of the surface mount and/or post solder evaluation techniques, such as x-ray inspection of solder joints, produces a reliable solder joint between the center pin and the center pin solder pad 88, which electrically couples to a center conductor of the PCB 72 through the center conductor via 90 to provide good high-frequency performance. Thus, the lid 62 and view port (see FIG. 1A, ref. num. 60) are omitted in some embodiments.

Figure 2A:
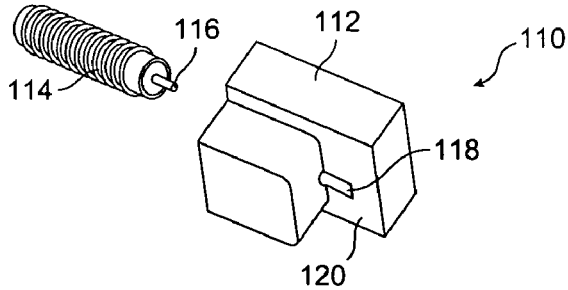
FIG. 2A shows an isometric view of a shielded edge launch connector according to another embodiment.

FIG. 2A shows an isometric view of a shielded edge launch connector 110 according to another embodiment of the invention. The shielded edge launch connector includes a shielded transition block 112 and a coaxial connector interface 114 that is not integrated into the shielded edge launch connector, but rather screwed into a threaded hole (see FIG. 2B, ref. num. 124) in the shielded transition block 112. This type of edge launch connector is known as a two-piece edge launch connector. Several styles of coaxial connector interfaces are available, including coaxial connector interfaces that have more than one piece. Some coaxial connector interfaces are not screwed into the shielded transition block. Alternatively, a coaxial connector interface is integrated with the shielded transition block (see FIG. 1A). The coaxial connector interface shown in FIG. 2A is commonly called an SMA barrel, and is adaptable for use with a variety of shielded transition blocks.

The coaxial connector interface 114 includes a center pin 116 that extends into an opening 118 in a flange 120 of the shielded transition block 112 when the coaxial connector interface 114 is screwed into the shielded transition block 112. The coaxial connector interface 114 is screwed into the shielded transition block 112 before the edge launch connector 110 is soldered to a PCB, at which time the portion of the center pin 116 extending into the opening 118 is soldered to a center pin solder area of the PCB. The flange is soldered to shielding solder areas on a surface of the PCB.

Some SMA barrels have dielectric material supporting the center pin that expands when heated, such as during solder reflow. An impedance-matched section of air line (see FIG. 2B, ref. num. 126) between the end of the dielectric material and the edge of the PCB provides a gap for the dielectric material to expand into and avoids forming a gap between the shielded edge launch connector and PCB that could result in an impedance discontinuity. Alternatively, an SMA barrel uses a glass-to-metal seal that does not significantly expand during solder reflow. Providing an impedance-matched section of air line in the shielded edge launch connector is desirable to accommodate dimensional variations (manufacturing tolerance) between the PCBs and shielded edge launch connectors.

Figure 2B:
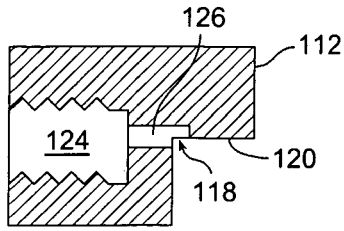
FIG. 2B shows a cross section of a shielded transition block of the shielded edge launch connector shown in FIG. 2A.

FIG. 2B shows a cross section of the shielded transition block 112 of the shielded edge launch connector 110 shown in FIG. 2A. A first hole 124 accepts the coaxial connector interface (see FIG. 2A, ref. num. 114). When the coaxial connector interface is threaded into the shielded transition block 112, the center pin (see FIG. 4A, ref. num. 116) extends into the opening 118 through a second hole 126. The diameter of the second hole 126 is chosen to provide a good impedance match between the coaxial interface and the PCB (not shown). The flange 120 of the shielded transition block 112 extending away from the hole 126, and other portions of the shielded transition block, are soldered to a PCB to provide a surface-mountable shielded edge launch connector.

Figure 2C:
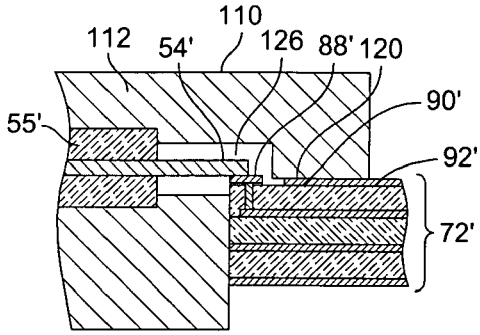
FIG. 2C shows a cross section of a portion of a system including the assembled shielded edge launch connector of FIG. 2A mounted on a PCB.

FIG. 2C shows a cross section of a portion of a system including the assembled shielded edge launch connector 110 mounted on a PCB 72'. A center pin 54' extends from a dielectric pin support 55' and is soldered to a center pin soldering pad 88'. A center conductor via 90' electrically couples the center pin 54' to a center conductor 92' of a planar transmission structure formed in the PCB 72'. The second hole 126 is a shielding cavity around the center pin 54' and the flange 120 extends beyond the tip (end) of the center pin 54', thus extending the shielding beyond the tip of the center pin 54'. The second hole 126 has a diameter selected to improve the impedance match between the coaxial connector interface (see FIG. 2A, ref. num. 114) and the planar transmission structure of the PCB 72'. Air is the dielectric portion of the coaxial transmission structure extending from the pin support 55' to the PCB 72', and is commonly called an air line coaxial transmission structure or simply an "air line". In some embodiments, the air line and coaxial connector interface have the same characteristic impedance.

Figure 3:
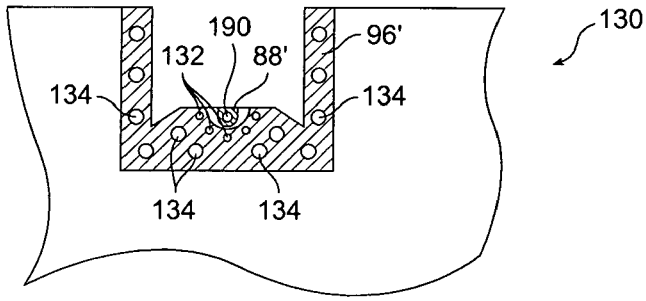
FIG. 3 shows a plan view of a PCB for use with a shielded edge launch connector.

FIG. 3 shows a plan view of a PCB 130 for use with embodiments of shielded edge launch connectors. The center conductor via 190 extends from the side of the PCB facing the viewer (i.e. "top" side) to a center conductor in an interior metal layer of the PCB or to a center conductor formed on the bottom metal layer of the PCB. Ground vias 132 extend from the top of the PCB to ground structures, such as interior ground planes, of the PCB. The ground vias 132 are placed in an arc around the center conductor via 190 to approximate a portion of the outer conductor of a coaxial transmission line. The size, spacing, and distance of the ground vias 132 from the center conductor via 190 are chosen to provide impedance matching from the center pin solder pad 88' to a planar high-frequency transmission structure formed in an interior metal layer(s) of the PCB 130 or on the opposite side ("bottom") of the PCB 130. The use of the center conductor via 190 for making a transition from the coaxial connector interface to the inner layer transmission line structure allows the transition to be completely shielded by solid sections of metal layers of the multi-layer PCB 130. Mechanical vias or through holes 134 are placed in the shielding solder area 96', i.e. under the shielding portion of the shielded edge launch connector (e.g. shielding 56 in FIG. 1A or flange 120 in FIG. 2B) to increase mechanical strength. The mechanical vias also allow excess solder to flow into them during solder reflow, instead of bulging out from under the shielding and shorting the center pin solder pad 88' to electrical ground.

II. Experimental Results

Figure 4A:
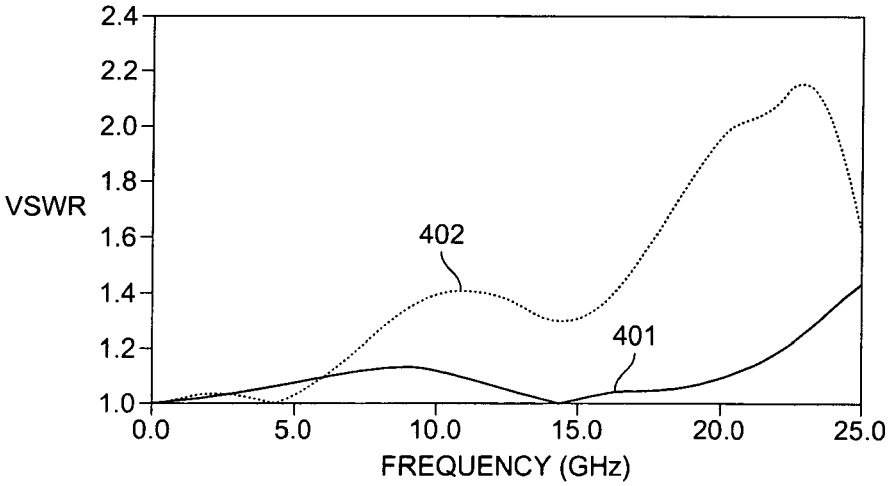
FIG. 4A shows plots of the voltage standing wave ratio versus frequency for a first PCA using a shielded edge launch connector made in accordance with FIGS. 2A–2C, and a second PCA using a prior art edge launch connector.

FIG. 4A shows plots of the voltage standing wave ratio ("VSWR") versus frequency for a first PCA using a shielded edge launch connector made in accordance with FIGS. 2A–2C, and a second PCA using a prior art edge launch connector ("end launch jack receptacle-tab contact) Model 142-0701-851™ purchased from Johnson Components of Waseca, Minn. Coaxial connectors are often characterized by their VSWR in the frequency domain. Each edge launch connector was soldered to essentially identical planar transmission structures in a PCB and measured with a Model 8722 network analyzer, available from Agilent Technologies, Inc. using gated time-domain reflectometry and transform techniques. The center conductors for the planar transmission structures were formed in interior layers of the PCB (ref. FIGS. 1C, 1D, and 2C), and the center pins of the edge launch connectors were coupled to the center conductors through center conductor blind vias.

A first plot 401 shows VSWR in the frequency domain for the first PCA built with the shielded edge launch connector embodiment. A second plot 402 shows VSWR in the frequency domain for the second PCA built with the Model 142-0701-851™ edge launch connector. The VSWR for the PCA built with the shielded edge launch connector is significantly less than for the PCA with the Model 142-0701-851™ edge launch connector, indicating less impedance discontinuity through the shielded edge launch connector.

Figure 4B:
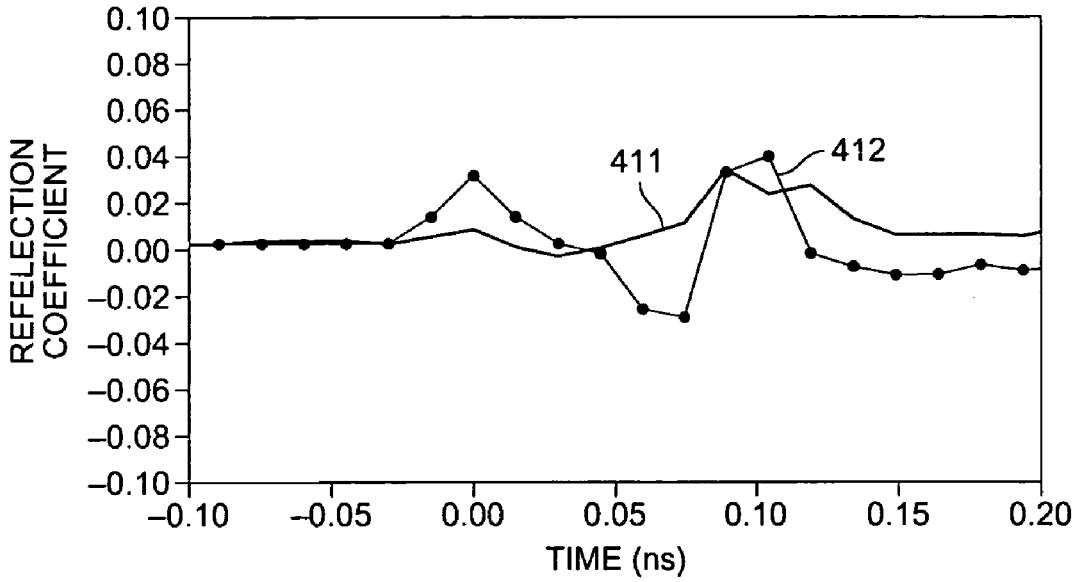
FIG. 4B shows plots of the reflection coefficients in the time domain for the first and second PCAs of FIG. 4A.

FIG. 4B shows plots of the reflection coefficients in the time domain for the first and second PCAs of FIG. 4A. Time domain reflection coefficient is often of interest to circuit designers, particularly those designing circuits to process digital signals. A first plot 411 shows the reflection coefficient of the first PCA built with the shielded edge launch connector. A second plot 412 shows the reflection coefficient of the second PCA built with the Model 142-0701-851™ edge launch connector. As with the VSWR plots, the plots of reflection coefficient show that the shielded edge launch connector provides superior impedance continuity.

III. Exemplary Methods

Figure 5:
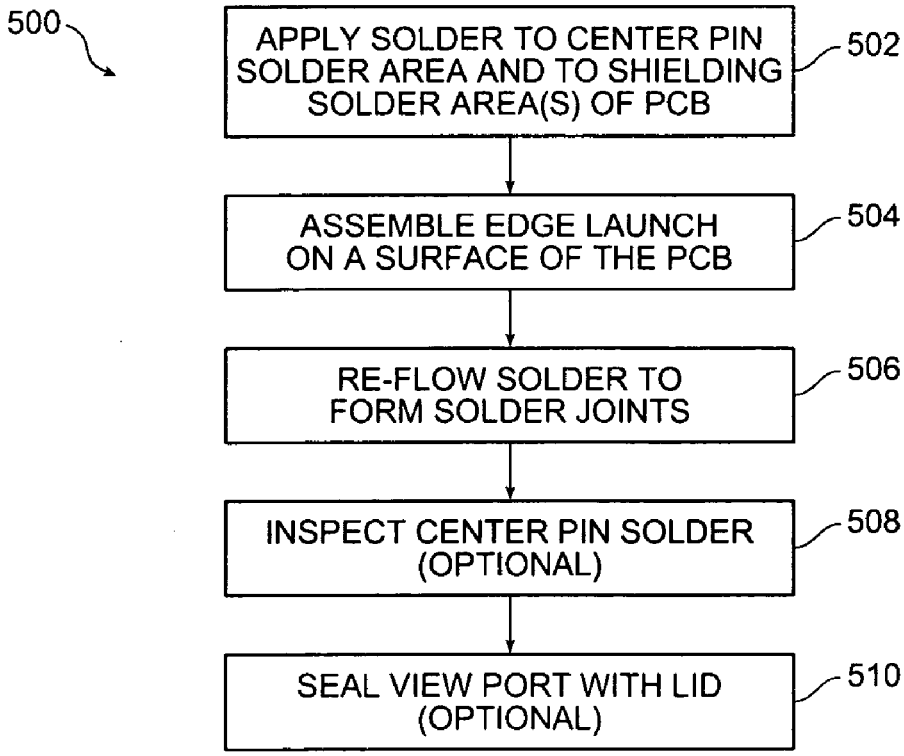
FIG. 5 is a flow chart of a method of mounting a shielded edge launch connector on a surface of a PCB according to an embodiment of the invention.

FIG. 5 is a flow chart of a method 500 of surface mounting a shielded edge launch connector on a surface of a PCB according to an embodiment of the present invention. Solder is applied to a center pin solder area and a shielding solder area(s) of the PCB (step 502). In one embodiment, the solder is automatically applied as a solder paste. In another embodiment, a solder preform(s) is used. In yet another embodiment, liquid heated solder is applied by hand or automatically. In alternative embodiments, the center pin and shielding of the edge launch connector are "tinned" with solder or a solder preform is applied to the edge launch connector, rather than applying solder to the PCB. Machine application of the solder as a paste provides a consistent amount of solder in the desired locations, resulting in more consistent high-frequency performance of the edge launch connector-PCB interface and fewer rejects arising from the center pin shorting to ground. In a particular embodiment, machine-vision solder paste inspection is used to confirm correct placement of the desired amount of solder paste prior to solder reflow.

The shielded edge launch connector is assembled on the PCB (step 504), and the solder is heated (commonly called "reflowing") (step 506) to form a first solder joint between a center pin of the edge launch connector and the center pin solder area of the PCB, and a second solder joint between a shielding portion of the edge launch connector and the shielding area(s) of the PCB to form an electromagnetic shield around the center pin of the edge launch connector. In a particular embodiment, the edge launch connector is pressed against an edge of the PCB during solder re-flow.

Optionally, the solder connection between the center pin and center pin solder area is inspected (step 508). In one embodiment, a visual inspection is performed through a view port in the shielding of the edge launch connector, and a lid is placed in the view port (step 510) after inspection. In an alternative embodiment, the solder joint between the center pin and the center pin solder area is inspected using x-ray or similar inspection techniques.

While the preferred embodiments of the present invention have been illustrated in detail, it should be apparent that modifications and adaptations to these embodiments might occur to one skilled in the art without departing from the scope of the present invention. For example, edge launch connectors using coaxial connector interfaces have been described. However, other embodiments might incorporate a coaxial cable ("pigtail") directly into an edge launch connector, soldering the center conductor of the cable to the PCB. Therefore, the scope of the present invention is set forth in the following claims.

What is claimed is:

1. A connector comprising:

a shielded transition block having shielding configured to extend beyond a center pin tip of a coaxial transmission structure;

a first hole configured to accept a coaxial interface having a center pin;

a second hole extending away from the first hole, the second hole having a diameter selected to form a controlled impedance air line with the center pin;

a flange configured to support the shielded transition block in a cutout of a printed circuit board and to be soldered to a surface of the printed circuit board; and an opening from the second hole to the flange configured to allow the center pin to extend into the opening and to be soldered to a solder pad on the surface of the printed circuit board.

2. The connector of claim 1 further comprising:

a coaxial connector interface;

a center pin support; and a center pin having a center pin portion extending away from the center pin support to the center pin tip.

3. The connector of claim 2 wherein the shielded transition block further comprises sidewalls configured to support the connector on a surface of a printed circuit board.

4. The connector of claim 2 wherein the coaxial connector interface is integrated with the shielded transition block.

5. The connector of claim 2 wherein the shielded transition block forms a controlled impedance structure with the center pin portion.

6. The connector of claim 2 wherein the shielded transition block forms a controlled impedance airline structure with the center pin portion.

7. The connector of claim 2 wherein the pin support comprises a glass-to-metal seal.

8. The connector of claim 2 further comprising a view port in the shielding providing a view of the center pin portion.

9. The connector of claim 8 further comprising a lid configured to seal the view port.

10. A connector comprising:

a shielded transition block having shielding configured to extend beyond a center pin tip of a coaxial transmission structure;

a coaxial connector interface;

a center pin a printed circuit board having a shielding solder area at an edge of the printed circuit board soldered to the shielding, a center pin solder pad at an edge of the printed circuit board soldered to the center pin, and a cutout in the edge of the printed circuit board; and sidewalls extending from the shielded transition block to engage the cutout.

11. A connector comprising:

a shielded transition block having shielding configured to extend beyond a center pin tip of a coaxial transmission structure;

a coaxial connector interface;

a center pin; and a printed circuit board having a shielding solder area at an edge of the printed circuit board soldered to the shielding;

a center pin solder pad at an edge of the printed circuit board soldered to the center pin, a center conductor of a planar controlled impedance transmission structure, and a center conductor via electrically coupling the center pin solder pad to the center conductor.

12. The connector of claim 11 further comprising a plurality of ground vias coupled to an outer conductor of the coaxial connector interface and selectively disposed in relation to the center conductor via to improve impedance continuity between the coaxial connector interface and the planar controlled impedance transmission structure.

13. The connector of claim 12 further comprising mechanical vias in the shielding solder area.

* * * * *

UNITED STATES PATENT AND TRADEMARK OFFICE

CERTIFICATE OF CORRECTION

PATENT NO. : 7,042,318 B2
APPLICATION NO. : 10/733982
DATED : May 9, 2006
INVENTOR(S) : Barnes et al.

It is certified that error appears in the above-identified patent and that said Letters Patent is hereby corrected as shown below:

In column 9, line 26, in Claim 10, after “pin” insert -- ; --.

In column 10, line 14, in Claim 11, after “shielding” delete “;” and insert -- , --, therefor.

Signed and Sealed this

Twelfth Day of September, 2006

JON W. DUDAS
*Director of the United States Patent and Trademark Office*